US005773747A

United States Patent [19]

Tellander et al.

[11] Patent Number: 5,773,747

[45] Date of Patent: Jun. 30, 1998

[54] TWO-PIECE AMMUNITION FLICK RAM

[75] Inventors: Robert Michael Tellander; Kenneth W. Hummel, both of Coon Rapids; Jeffrey F. Kezar, St. Paul, all of Minn.

[73] Assignee: United Defense, LP, Arlington, Va.

[21] Appl. No.: 954,809

[22] Filed: Oct. 21, 1997

Related U.S. Application Data

[63] Continuation of Ser. No. 646,206, May 7, 1996, abandoned.

[51] Int. Cl.[6] ..... F41A 9/43

[52] U.S. Cl. ..... 89/47; 89/45

[58] Field of Search ..... 89/45, 46, 47

[56] References Cited

U.S. PATENT DOCUMENTS

| | | | |
|---|---|---|---|
| 3,242,815 | 3/1966 | Christiansson | 89/46 |
| 4,777,863 | 10/1988 | De Haven et al. | 89/47 |
| 5,168,121 | 12/1992 | Maynard | 89/45 |
| 5,335,580 | 8/1994 | Mouterde et al. | 89/47 |
| 5,390,583 | 2/1995 | Berglund | 89/47 |
| 5,440,966 | 8/1995 | Tellander et al. | 89/46 |
| 5,563,363 | 10/1996 | Soulaigre et al. | 89/46 |

*Primary Examiner*—J. Woodrow Eldred

*Attorney, Agent, or Firm*—Douglas W. Rudy; Michael B.K. Lee

[57] ABSTRACT

This invention relates to a material handling system. More particularly, the invention pertains to the method and apparatus for automatically loading a two-piece ammunition into a gun tube. A continuous rammer mechanism having a plurality of strategically spaced pawls is structured to accelerate the two-piece ammunition into the gun tube. The system compensates for different angles of gun trajectory by adjusting the speed and output of a drive motor to thereby provide a consistent ramming acceleration of the ammunition.

8 Claims, 6 Drawing Sheets

TWO-PIECE AMMUNITION FLICK RAM

This is a Continuation of application Ser. No. 08/646,206 filed May 7, 1996, now abandoned.

FIELD OF THE INVENTION

The present invention pertains to an advanced Naval gun system and the loading mechanism associated therein. More specifically, the present invention relates to a ramming system which utilizes a partial stroke to conserve scarce space as well as provide a short cycle time and significant mechanical advantages in handling two-piece ammunition.

BACKGROUND OF THE INVENTION

Existing gun systems such as the MK 45 include loading mechanisms which push a powder case and a projectile all the way into the gun chamber and a rammer mechanism which stops with the powder case at the breech face. The rammer pawl holds the powder case in position until the breech block moves partway down to hold the powder case at the breech face while the rammer retracts. This process involves a number of mechanical units and requires the coordination and proper timing of the units. Further, reliability and rate of fire are negatively impacted because of several moving parts and the attendant long ram time cycle involving these parts.

Current full stroke ramming devices therefore are not compatible with modern gun initiatives which, inter alia, require enhancements in reliability, maintainability, and performance while reducing gun system weight and cost. Among the multiphase development undertaken to meet these initiatives includes a unique process to transfer ammunition from a lower to an upper gun handling system. The assignee of the present application, FMC/United Defense, is also the assignee of U.S. Pat. No. 5,440,966 which issued on Aug. 15, 1995 wherein a material handling system specifically adapted to transfer projectiles from a lower to an upper gun handling system is disclosed and is incorporated herein by reference. The advances disclosed in U.S. Pat. No. 5,440,966 prompted new restraints on the existing ramming system and made a partial stroke ramming highly practicable and necessary.

While existing ramming mechanisms have proven effective, it would be desirable to reduce the weight, size, number of mechanical components and ramming cycle time. Accordingly, development of efficient ramming mechanisms is needed. As will be set forth below, the present invention meets these and other needs.

SUMMARY OF THE INVENTION

The present invention discloses a method and device in which a multi-piece ammunition is transferred from one handling system to another.

The present invention is a significant improvement over the prior art. In light of the advances disclosed in U.S. Pat. No. 5,440,996 the method and device of the present invention involve flicking a multi-piece ammunition into the breech of a gun tube. Specifically, a powder case and a projectile are rammed into a gun barrel chamber to be readied for firing. The flick ram structure includes pawls, cams, sensors, proximity switches, chain and sprocket mechanisms which are integrated with solenoids to operate the mechanism. The control and actuation system may comprise hydraulic and or electrical controls. Generally, the flick ram mechanism accelerates the rammer pawl at a rate predetermined by the gun's control system, which is based on the gun's current elevation enabling the powder case and projectile to continue in free flight and ultimately rest in the gun chamber. A latch snaps in behind the powder case and secures it to the breech face. There are two rammer pawls so that one pawl will be in the rear position ready to ram ammunition. The present invention thus eliminates retraction time relative to the movement of the breech block. In the prior art practice, for example, a powder case and projectile are rammed all the way into the gun chamber and a rammer pawl or equivalent stops with the powder case at the breech face. Then the breech block partially closes thus holding the powder case in position while the rammer retracts. The present invention eliminates these steps with the attendant advantages of increased firing rate, mechanical simplicity as well as efficiencies in weight, space and volume of the rammer mechanism.

The embodiments disclosed herein indicate some of the various advances of the present invention. These embodiments provide methods and devices for ramming which yield very high economies in weight, volume and space as well as promote efficiency in firing rate and performance of a gun system. Other features and advantages of the present invention will become apparent upon examination of the following description and drawings dealing with specific embodiments thereof.

BRIEF DESCRIPTION OF THE DRAWINGS

In the drawings, in which like reference numbers indicate corresponding parts of the preferred embodiments of the present invention throughout the several views.

DESCRIPTION OF THE PREFERRED EMBODIMENT

Figure 1:
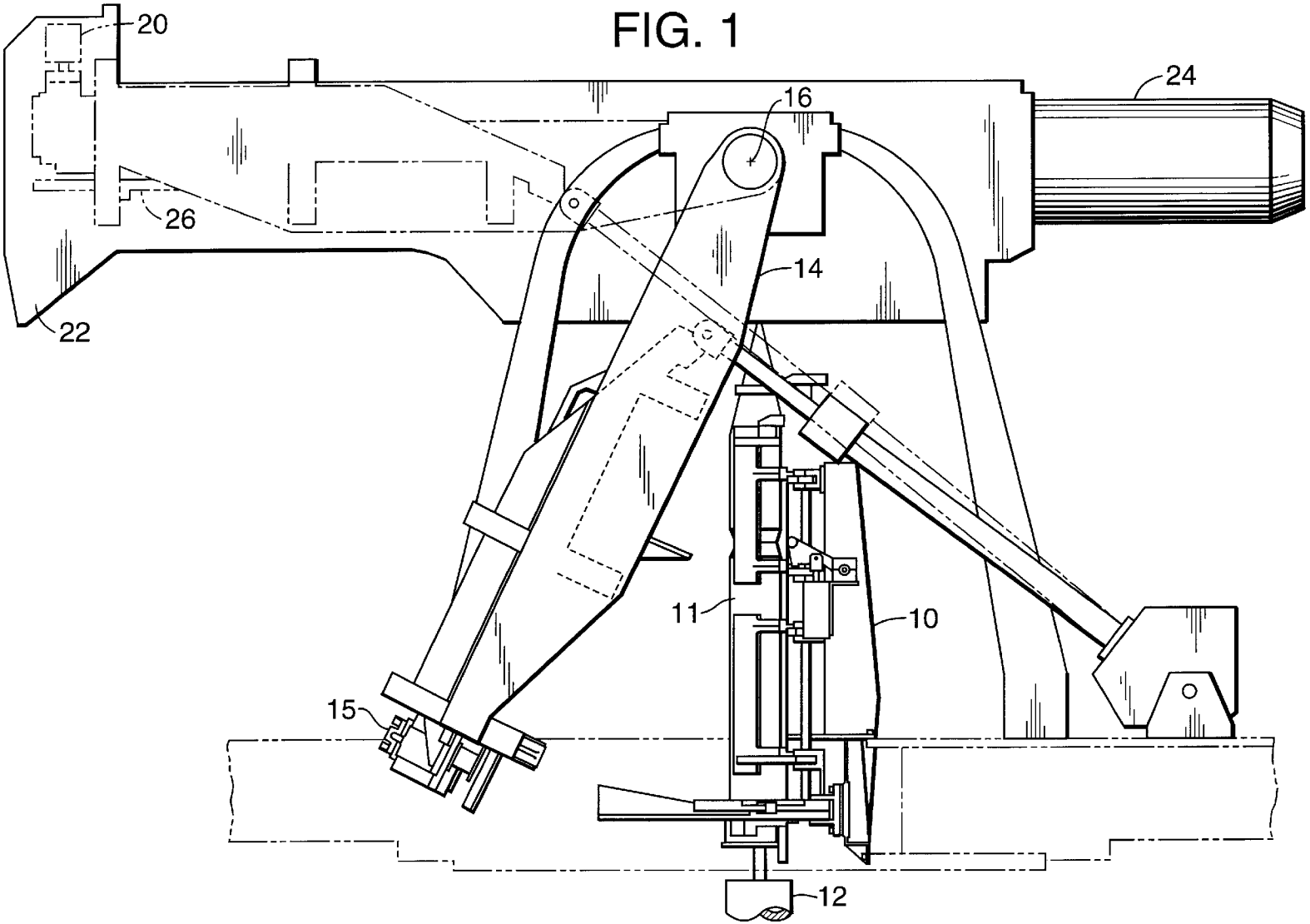
FIG. 1 is an assembly drawing showing a projectile transfer system associated with the rammer of the present invention.
Figure 3:
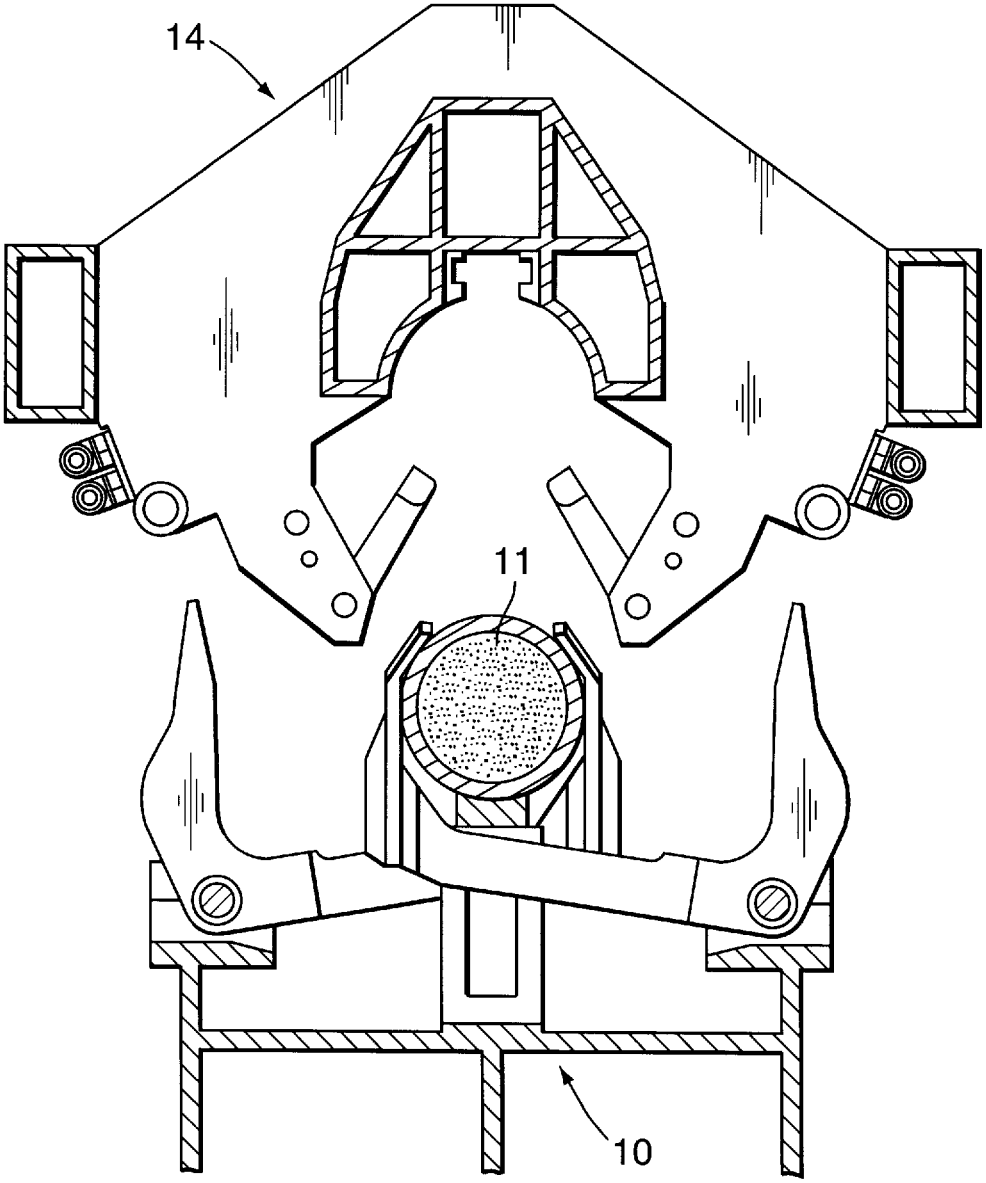
FIG. 3 is a sectional view of the cradle and load station about to engage each other for the transfer of a projectile.

Referring now to the drawings, and in particular to FIG. 1, load station 10 is shown supporting ammunition 11 which is transferred from storage via ammunition hoist tube 12. Cradle 14 pivots about trunnion support 16 until fully engaged by load station 10. FIG. 3 is a cross sectional view showing the engagement of cradle 14 with load station 10. Ammunition 11 is transferred from load station 10 to cradle 14 using cams and hydraulic means which cooperate to transfer and secure ammunition 11 in cradle 14.

Figure 2:
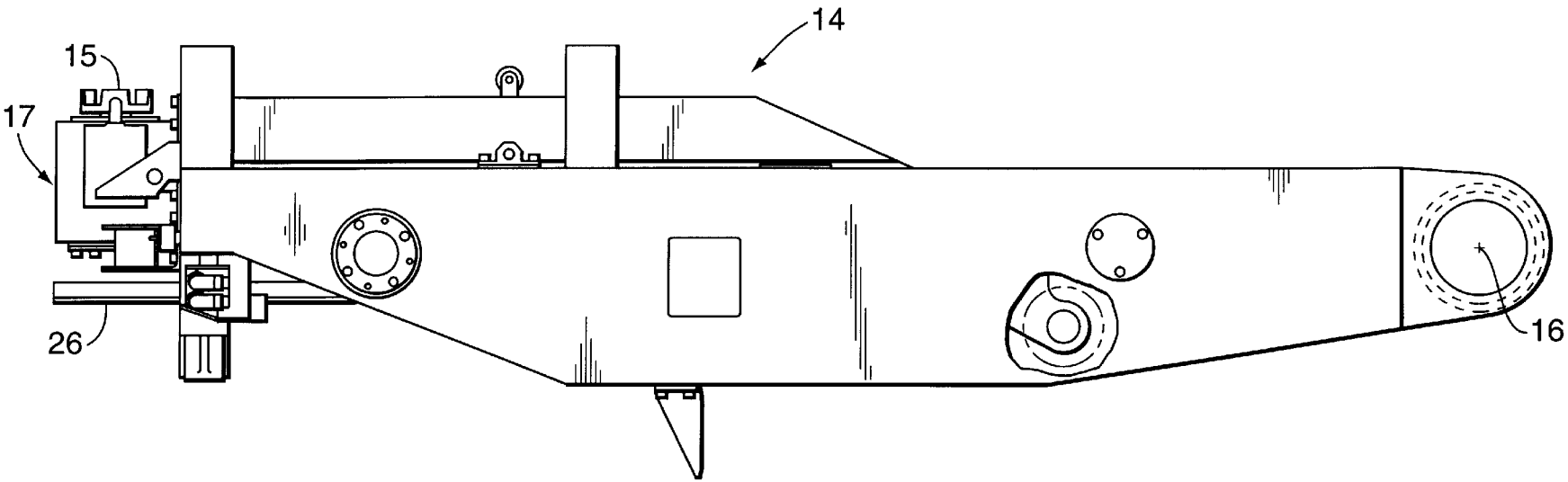
FIG. 2 is a side view of a cradle assembly.

Turning now to FIG. 2, a side view of cradle 14 in a horizontal orientation is shown. Cradle 14 is mechanically moved from a substantially vertical position to a position within the gun recoil slide 22, concentric to the gun tube 24. Crown gear 15 on cradle 14 mates with drive motor 20. Cradle 14, including drive assembly 17, stows within gun recoil slide 22 and is disposed coaxial with gun tube 24. A plurality of continuous rails 26 are installed to provide a transfer mechanism for ammunition.

Figure 4:
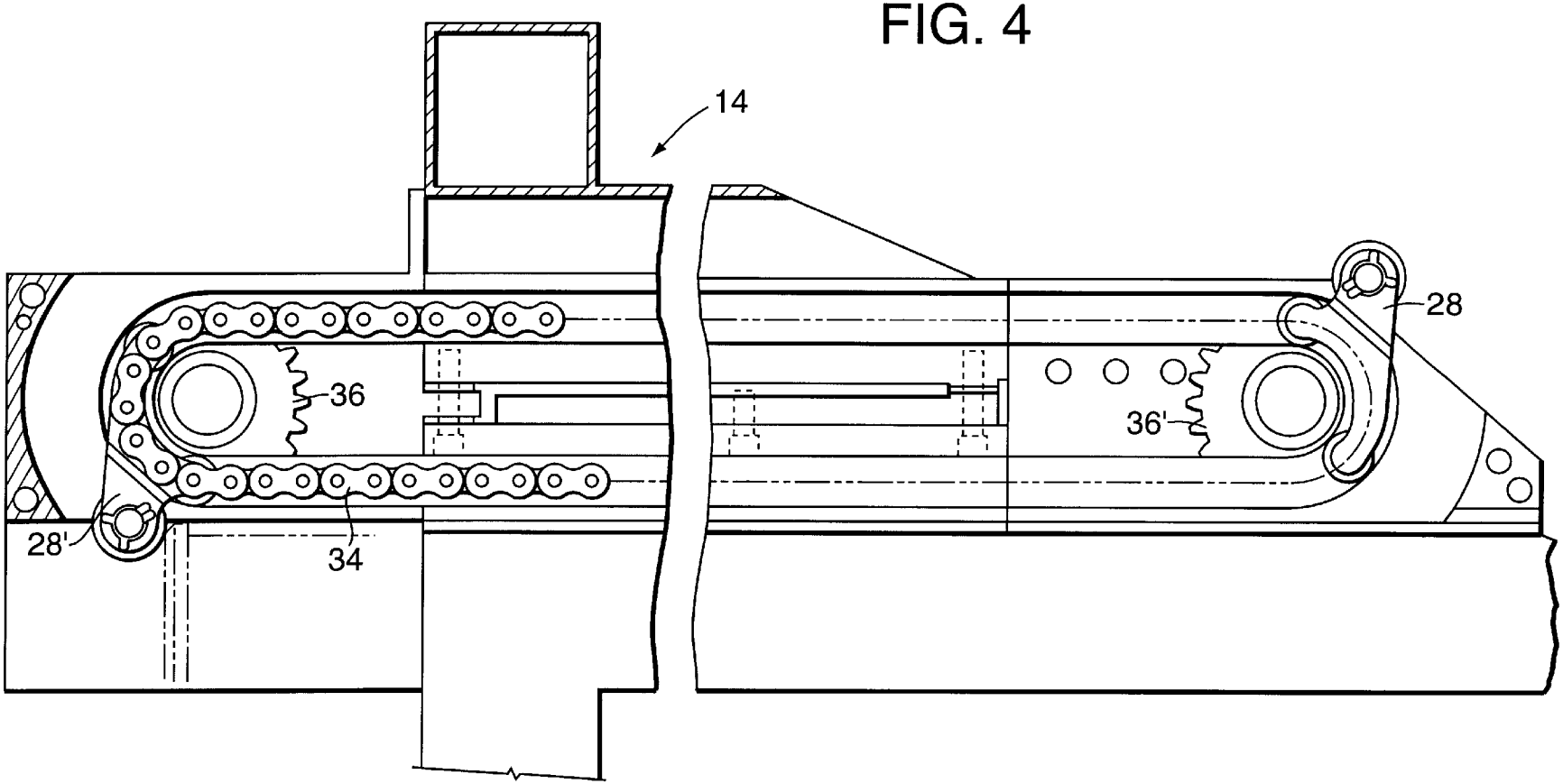
FIG. 4 is a sectional view of the rammer.

FIG. 4 is a sectional view of the preferred embodiment of the present invention. Rammer pawls 28 and 28' are attached to chain 34. Drive motor 20 drives rammer sprocket 36 and idler sprocket 36'.

Figure 5A:
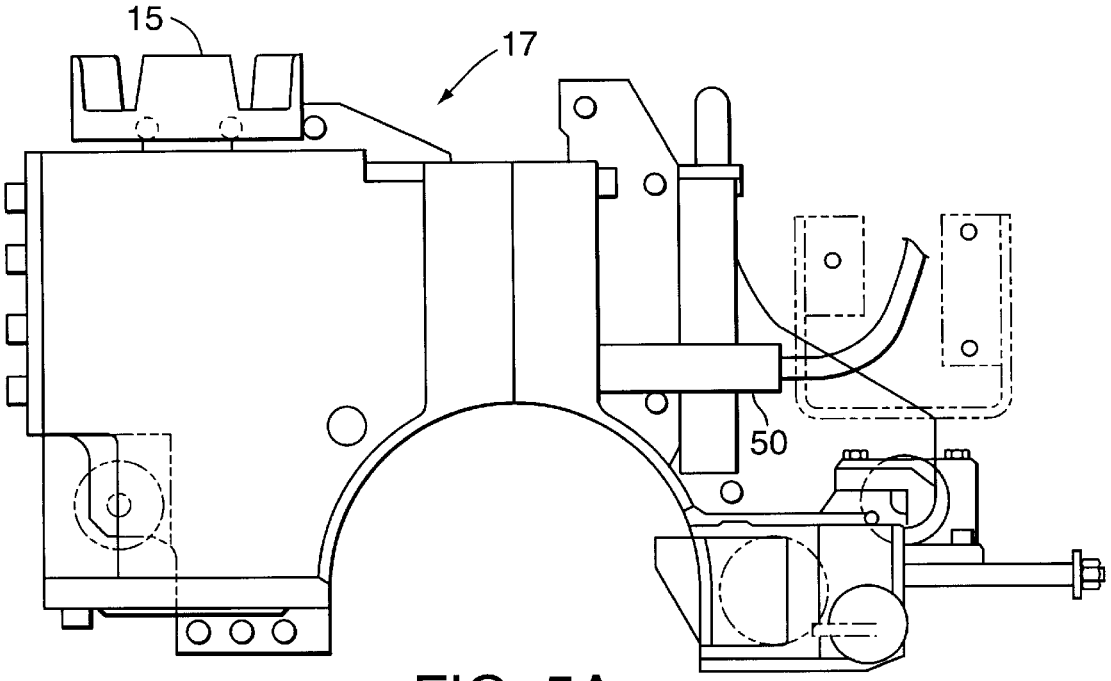
FIG. 5A is a side view showing a pawl sensor (proximate switch).
Figure 5B:
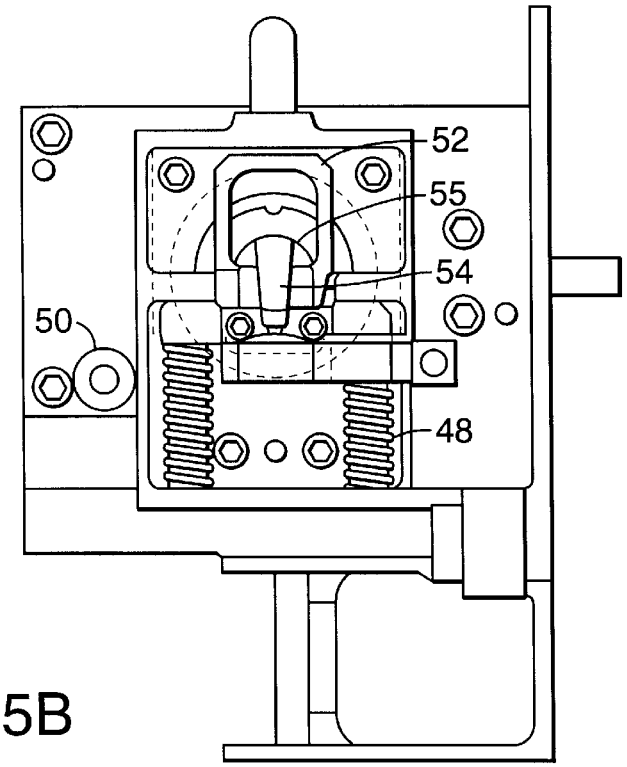
FIG. 5B is a front view showing a pawl sensor (proximate switch).

FIGS. 5A and 5B show springs 48, pawl sensor 50 and latch 52. Pawl sensor 50 is a proximity switch and mounts on the back of Cradle 14 as shown. The figures further show the structural organization of the flick rammer latch mechanism such as tapered flats 54 at the end of the drive shaft 55.

Figure 6:
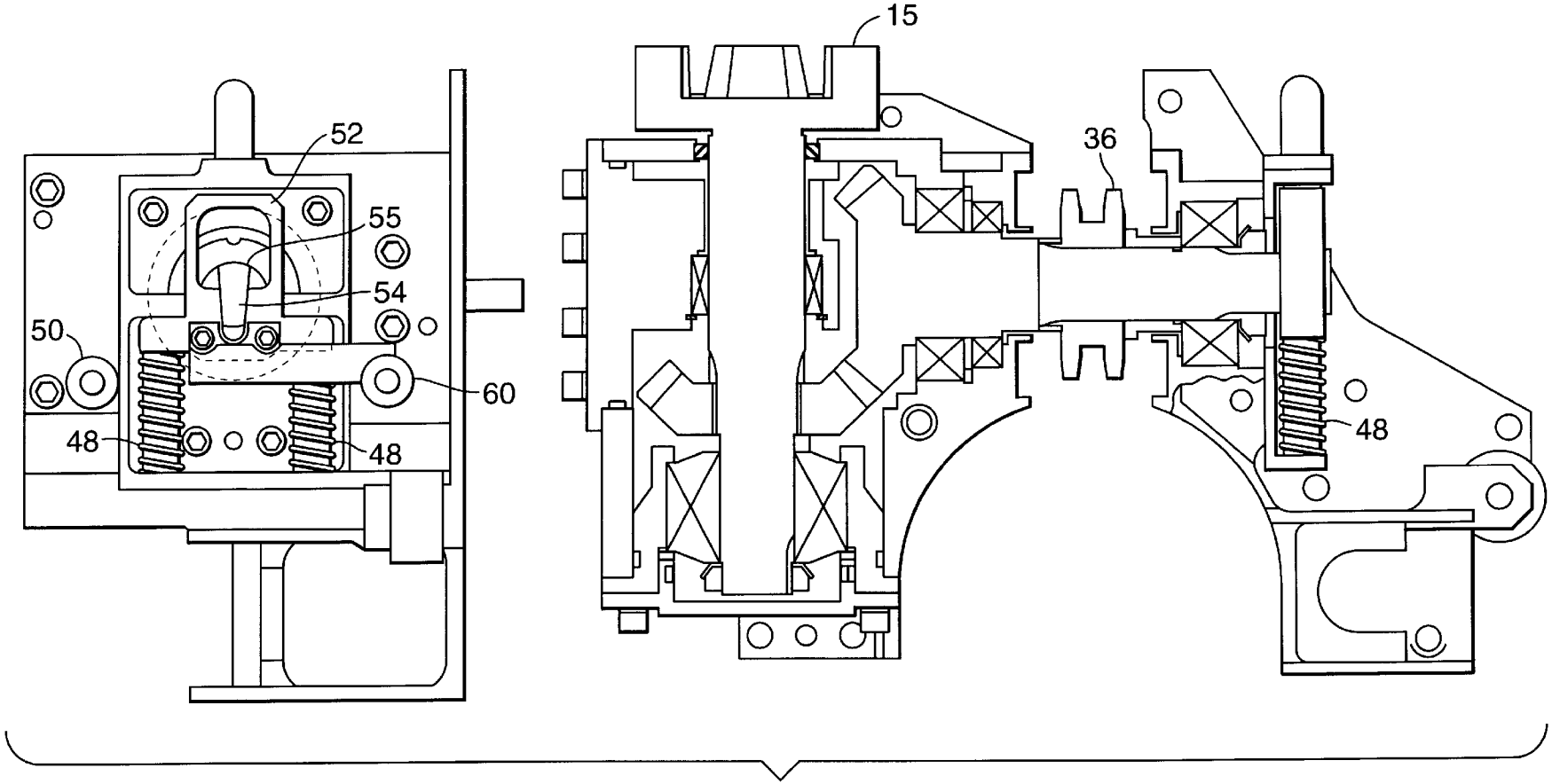
FIG. 6 is a front view showing an indicator switch mounted on a bracket.

FIG. 6 shows switch 60 mounted on a bracket. Switch 60 confirms the engagement of latch 52 with shaft 55.

The discussion hereinabove briefly discloses the structural organization of some of the most important elements of the present invention relative to the preferred embodiment.

The following discussion relates to the operation and cooperative performance of the elements of the present invention. The flick rammer method and device disclosed herein is the final stage in the transfer of ammunition from a storage compartment to a gun tube. Referring now to FIGS. 1–6, ammunition (two-piece) 11 is first transferred into load station 10 via ammunition hoist tube 12. Cradle 14 pivots downward about trunnion centerline 16 until fully engaged by load station 10. After the full engagement of cradle 14, load station 10 transfers ammunition 11. The ammunition 11 is positively received and stored in cradle 14. Thereafter, cradle 14 pivots upwards until its center line is concentric with the gun tube 24. As a result of this concentric alignment with gun tube 24, cradle 14 engages gun recoil slide 22. At this point in time, hydraulic motor 20 is activated to thereby initiate rammer sprocket 36. Accordingly rammer pawls 28 and 28', which are attached to chain 34, are mobilized to push ammunition 11 forward into gun tube 24. The peak rammer pawl velocity is controlled by the gun's control system, based on the current gun elevation angle to assure that the ammunition will be fully seated and latched within the gun tube chamber. The rammer pawl stroke is fixed so that when one rammer pawl stroke is complete, second and consecutive rammer pawl is in position for the next ram.

A detailed operation of the present invention is disclosed with reference to FIGS. 5A, 5B and 6; a section through drive assembly 17 mounted to the back of cradle 14 is shown (also see FIG. 2). Crown gear 15 engages drive motor 20. Further, the lower end of crown gear 15 is a right angle bevel gear connected to the rammer sprocket 36. This arrangement enables drive motor 20 to turn/drive rammer sprocket 36. It should be noted that similar or equivalent arrangements may be used to drive rammer sprocket 36.

Further, referring to FIG. 6, springs 48 are structured to push latch 52. When latch 52 is pushed upwards it engages tapered flats 54 at the end of the drive shaft 55 thus preventing shaft 55 from rotating. Latch 52 is automatically disengaged when cradle 14 is in the ramming position within gun recoil slide 22. When cradle 14 engages gun recoil slide 22 a surface of recoil slide 22 pushes or bears downwards thereby unlatching the sprocket 36 and the chain 34 assembly (also see FIG. 4). Latch 52 will not be disengaged until crown gear 15 has securely meshed with the mating crown gear of drive motor 20. As indicated hereinabove, proximity switch 60 monitors latch 52. Proximity switch 60 reads switch activator (not shown) which is mounted adjacent to latch 52.

The location of rammer pawls 28 and 28' is monitored by pawl sensor 50. Further, switch 60 signals when drive shaft 55 is securely latched. Additionally, a resolver (not shown) is mounted on drive motor 20. The resolver is initiated when rammer pawl 28' is sensed by pawl sensor 50 and when drive shaft 55 is confirmed latched.

Accordingly, the present invention provides a rammer mechanism which operates in cooperation with the ammunition transfer gun system. It enables the loading of a two-piece ammunition in a gun tube and provides a complete material handling system wherein the ammunition is automatically transferred from storage into the gun tube.

Although the best mode contemplated for carrying out the present invention has been herein shown and described, it will be apparent that modification and variation may be made without departing from what is regarded to be the subject matter of the invention.

What is claimed is:

1. A rammer mechanism implemented in a gun system to cooperatively operate with a loading and conveying system for ammunition to be conveyed to a gun tube, the rammer mechanism comprising;

means for transferring ammunition into a gun recoil slide;

a motor to initiate the rammer mechanism;

means for sensing pawls on the rammer mechanism;

means for positively locating positions of said pawls; and means for uniformly accelerating the ammunition to enable uniform acceleration at various angles of inclination of the gun tube; and said means for transfer, said motor to initiate, said means for sensing; said means for positively locating and said means for uniformly accelerating having mechanical cooperation such that said pawls which are attached to a chain on the rammer are mobilized to push ammunition forward into the gun tube and further that an electric sensor senses and locates said positions of the pawls.

2. The rammer mechanism of claim 1 wherein said motor includes a variable speed hydraulic motor which engageably operates with said means for transferring ammunition thereby forming a cooperative structure including said means for uniformly accelerating.

3. The rammer mechanism of claim 1 wherein said electric sensor includes a proximity switch to thereby initiate, control and turnoff said rammer mechanism.

4. A rammer mechanism to ram a two-piece ammunition into a gun tube and provide a consistent ram acceleration of the ammunition irrespective of the angle of the gun tube, the rammer mechanism comprising:

means for transferring ammunition into a gun recoil slide;

a motor to initiate the rammer mechanism;

means for sensing pawls on the rammer mechanism;

means for locating positions of said pawls; and a continuous chain link for continuously moving said pawls;

said means for transferring, said motor to initiate, said means for sensing, said means for locating and said means for moving having mechanical cooperation such that said pawls attached to the chain link are mobilized to push ammunition forward into the gun tube and further that an electric sensor senses and locates said positions of the pawls.

5. The rammer mechanism of claim 4 wherein said continuous chain link for moving said pawls includes a variable speed motor, a chain and sprockets driving said chain to which said pawls are attached.

6. A method for ramming an ammunition into a gun tube chamber wherein a rammer device in cooperation with a loading and conveying system rams an ammunition into a gun tube, comprising the device implemented steps of:

sensing engagement of the rammer mechanism with the loading and conveying system;

activating a chain and sprocket system;

controlling the rammer velocity using a control system from the gun based on current gun elevation angle to thereby assure that the ammunition is fully seated and latched within the gun tube chamber and enable uniform acceleration at any angle of inclination of the gun tube; and urging the ammunition forward into the gun tube using uniform acceleration via pawls attached to said chain.

7. The method according to claim 6 wherein a drive motor is driven at various speeds based on the angle of inclination of the gun tube to thereby provide a constant accelerating force against the ammunition and enable said step of controlling the rammer velocity to maintain uniform acceleration of the ammunition at any angle of inclination of the gun tube.

8. The method according to claim 6 wherein said pawls are always positioned and fixed at a predetermined location before and after activation of said chain and said sprocket and said predetermined positions are known before initiation and turn off of the rammer device.

* * * * *